United States Patent [19]

Pyle

[11] 4,204,563

[45] May 27, 1980

[54] DISCHARGE SPOUT TIP FOR A LIQUID FUEL-DISPENSING NOZZLE

[75] Inventor: Walter R. Pyle, Richmond, Calif.

[73] Assignee: Chevron Research Company, San Francisco, Calif.

[21] Appl. No.: 948,187

[22] Filed: Oct. 2, 1978

[51] Int. Cl.[2] ..... B67C 3/28; B65B 3/04

[52] U.S. Cl. ..... 141/206; 141/1; 141/286; 141/392; 29/157 C

[58] Field of Search ..... 141/206–229, 141/285–310, 392, 1, 84, 339, 59; 138/37, 39; 222/575; 29/157 C

[56] References Cited

U.S. PATENT DOCUMENTS

| | | | |
|---|---|---|---|
| 1,582,369 | 4/1926 | Aske | 137/37 |
| 2,320,496 | 6/1943 | Wechsler | 222/575 |
| 2,348,480 | 5/1944 | Kerr | 141/286 |
| 4,058,149 | 11/1977 | Hansel | 141/301 |
| 4,060,108 | 11/1977 | Weston et al. | 141/59 |
| 4,060,110 | 11/1977 | Bower | 141/207 |

FOREIGN PATENT DOCUMENTS

| | | | |
|---|---|---|---|
| 1014483 | 12/1965 | United Kingdom | 141/286 |

*Primary Examiner*—Houston S. Bell

*Attorney, Agent, or Firm*—R. L. Freeland, Jr.; William J. Egan, III

[57] ABSTRACT

A discharge spout tip for a fuel-dispensing nozzle wherein the outlet end of the tip has a cross-sectional area approximately equal to that of the discharge spout inwardly of the tip and wherein the tip has a downwardly sloping, upper surface for deflecting fuel flowing through the outlet end of the tip in a generally downward direction at an effective angle of deflection from the center line of the discharge spout so that the fuel flow is directed away from the upper surface of the fill pipe in order to prevent the formation of a liquid barrier in the fill pipe. By reducing or eliminating the liquid barrier in the fill pipe, the likelihood of occurrence of a spitback or spill is reduced. The fuel-deflecting surface of the tip may be formed by positioning a wedge-shaped projection on the upper surface of the tip, and alternately, the upper surface of the tip itself may slope downwardly from a point on said discharge spout to form a fuel-deflecting surface.

35 Claims, 10 Drawing Figures

30
14
80

30
14
44
90

14
24
50
80
X
θ
95
Y
96
82

47
90
14
95
24
50
4
4
80
82

DISCHARGE SPOUT TIP FOR A LIQUID FUEL-DISPENSING NOZZLE

FIELD OF THE INVENTION

The present invention relates to liquid fuel-dispensing nozzles for dispensing fuel into vehicle fuel tanks, and more particularly, to a discharge spout tip for a fuel dispensing nozzle, especially those nozzles having a vapor-recovery system.

BACKGROUND OF THE INVENTION

In an attempt to reduce hydrocarbon emissions, environmental regulations in certain areas of the country require that gasoline vapors displaced from vehicle fuel tanks during refueling are to be recovered in order to prevent their escape into the atmosphere. Accordingly, nozzle assemblies incorporating vapor recovery systems have been designed to comply with these regulations. As is known in the art, many of these nozzles have a vapor-recovery system for receiving the vapors displaced from the fuel tank and storing them in a service station's underground hydrocarbon storage tank. These nozzles normally include a discharge spout that extends into the mouth of the fill pipe of the fuel tank and a vapor-recovery shroud that fits in sealing engagement with the mouth of the fill pipe during refueling so as to receive the vapors displaced from the fuel tank. With this arrangement, vapors in the fuel tank are displaced from the tank as gasoline is pumped into the tank. The displaced vapors will then flow by way of the shroud into a vapor-recovery passage in the nozzle and from there by appropriate means to a hydrocarbon storage tank.

Two problems that commonly arise in the use of vapor-recovery nozzles are the occurrence of spitback and spills. Spitback and spills may also occur when using fuel-dispensing nozzles not incorporating a vapor-recovery system; however, with these nozzles the problem is neither as severe nor the occurrence as frequent as with vapor-recovery nozzles. Spitback may be said to occur when a liquid spray is forcefully ejected from the fill pipe of a vehicle fuel tank when the nozzle is shut off and the flow of fuel into the tank is stopped. Spills may simply be defined as fuel that spills from the nozzle when the nozzle is removed from the fill pipe or that slops out of the fill pipe when the nozzle is shut off. Spitback and spills are undesirable in that they may strike the vehicle and/or the operator of the nozzle, and that they produce hydrocarbon emissions which offset the gain made towards the recovery of escaping vapors by the use of vapor-recovery nozzles.

When a vehicle is being refueled, and considering the fill-pipe geometries of various vehicle fuel tanks, it is likely that the discharge spout of the nozzle will be inserted into the fill pipe in such a way that fuel flowing through the outlet end of the discharge spout will initially strike the upper surface of the fill pipe. It can be expected that the fuel will strike the upper surface of the fill pipe with a high velocity and turbulent flow causing the fuel to flow along the upper surface and sides of the fill pipe. Downstream from the point where the fuel initially strikes the upper surface of the fill pipe, the fuel will drop from the upper surface of the fill pipe to its lower surface, establishing a liquid barrier in the fill pipe through which vapor displaced from the fuel tank must pass. The liquid barrier acts as an impediment to the flow of vapor through the fill pipe which leads to a buildup of vapor pressure in the ullage or head space of the fuel tank. A pressure differential is thereby established across the liquid barrier wherein the pressure in the head space of the fuel tank, which is downstream of the barrier, is greater than the pressure in the fill pipe near the point of insertion of the discharge spout, which is upstream of the barrier. Therefore, when the flow of fuel into the tank is stopped, vapor flow transients may occur while the pressures on opposite sides of the liquid barrier are equalizing. The sudden equalizations of pressures on opposite sides of the barrier, especially where there is a very high pressure differential across the barrier, can cause fuel to be forcefully ejected from the fill pipe which, as defined above, is known as spitback. The equalizations of the barrier pressures may also cause a spill to occur where fuel slops out of the fill pipe or flows into the nozzle where it can subsequently spill to the ground.

The formation of a liquid barrier in the fill pipe can also cause another problem known as recirculation. Recirculation can occur in vapor-recovery nozzles when fuel droplets are entrained in the vapor as it passes through the liquid barrier and carried into the vapor-recovery line, which connects the nozzle to the fuel dispenser. Fuel droplets entrained in the vapor and carried into the vapor-recovery system are undesirable for two reasons: first, the customer is charged for fuel that he did not receive, and second, entrained fuel droplets can separate out from the vapor causing a liquid trap to be formed in the vapor-recovery line which acts as a barrier to the flow of vapor through the line which, in turn, can cause a further build-up of vapor pressure in the tank head space. The higher pressure in the tank head space has the effect of increasing the likelihood of the occurrence of spitback.

Fuel dispensing nozzles that are currently available, such as those described in U.S. Pat. Nos. 4,060,110 and 4,058,149, do not eliminate the heretofore-described problems. Accordingly, the present invention is directed to a design for a discharge spout tip for a fuel-dispensing nozzle wherein liquid barrier formation in the fill pipe is either reduced or eliminated, thereby reducing the likelihood of the occurrence of spitbacks, spills and recirculation.

SUMMARY OF THE INVENTION

In accordance with the present invention, a tip for a discharge spout of a fuel-dispensing nozzle is provided wherein the tip has an upper surface that slopes downwardly to form a fuel-deflecting surface for deflecting the fuel flow through the outlet end of the tip at an effective angle of deflection from the center line of the discharge spout so that the fuel flow is directed away from the upper surface of the fill pipe. By directing the fuel flow away from the upper surface of the fill pipe, liquid barrier formation in the fill pipe may either be reduced or eliminated, which reduces the frequency of occurrence of spitback and spills.

To provide the requisite fuel-deflecting surface in the tip, a wedge-shaped projection having a downwardly sloping surface may be positioned on the upper surface of the tip. The tip may also be formed so that its upper surface slopes downwardly from a point on the discharge spout to deflect fuel flowing through the oulet end of the tip. In either case, the outlet end of the tip is angled inwardly of the upper surface of the tip so that the cross-sectional area of the outlet end of the tip is approximately equal to that of the flow passage extending through the discharge spout inwardly of the tip.

PRINCIPAL OBJECT OF THE INVENTION

A particular object of the present invention is to provide a discharge spout tip for a liquid fuel-dispensing nozzle which has an outlet end of cross-sectional area approximately equal to that of the discharge spout inwardly of the tip and which has a downwardly sloping surface for deflecting fuel flowing through the discharge spout and out the outlet end in a generally downward direction at an effective angle of deflection from the center line of the discharge spout so that fuel flowing through the outlet end is directed away from the upper surface of the fill pipe in order to prevent the formation of a liquid barrier in the fill pipe.

Additional objects and advantages of the invention will become apparent from a detailed reading of the specification and drawings which are incorporated herein and made a part of this specification.

DESCRIPTION OF THE PREFERRED EMBODIMENT

For illustrative purposes, the discharge spout tip configuration of the present invention is described with respect to a vapor-recovery dispensing nozzle of the type shown in U.S. Pat. No. 4,060,110. It is noted, however, that the present invention may be used with most any type of liquid fuel-dispensing nozzle, including nozzles not having a vapor-recovery system.

Figure 1:
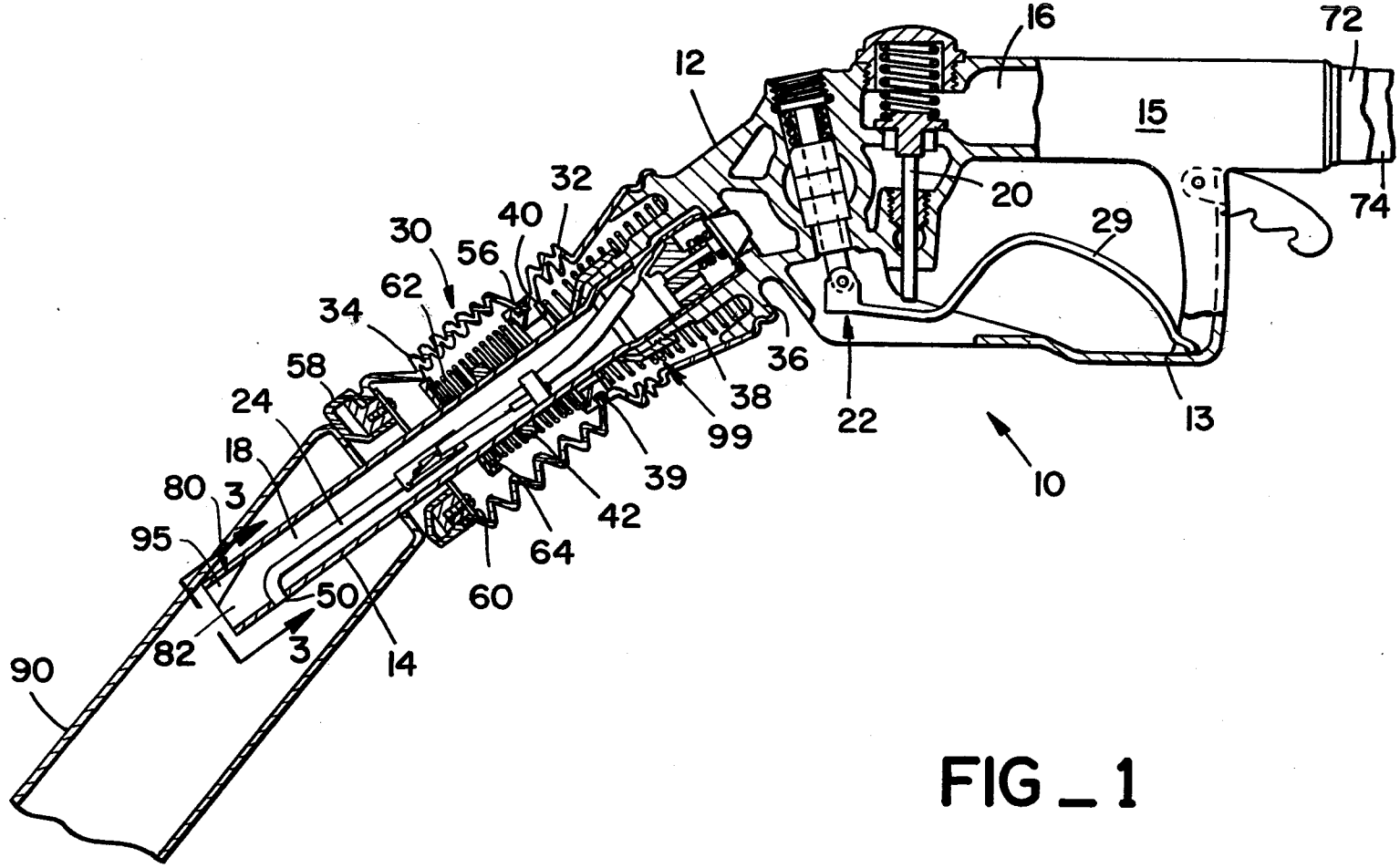
FIG. 1 is a longitudinal sectional view of a vapor-recovery dispensing nozzle according to an embodiment of the present invention wherein the discharge spout of the nozzle is operatively inserted within the fill pipe of a fuel tank.

Referring now to the drawings, FIG. 1 represents a vapor-recovery dispensing nozzle 10 having a main body portion or housing 12 with an open-end discharge spout 14 projecting from the nozzle main body portion for insertion into fill pipe 90 of a vehicle fuel tank. The discharge spout further includes a tip, identified generally by the numeral 80, having an outlet end 82 and proportioned for ease of insertion into the fill pipe 90. The main body portion 12 has a liquid flow passage 16 extending therethrough with one end of passage 16 in communication with flow passage 18 in the discharge spout 14. The other end of liquid flow passage 16 is in communication with fuel hose 72 which is connected between the nozzle 10 and the fuel dispenser, which is not illustrated.

A flow control valve 20 is located in the flow passage 16 for opening and closing the passage to regulate the flow of fuel through the passage. Valve 20 may be actuated by squeezing lever 29 of the releasable latching mechanism, identified generally by reference numeral 22, in the direction toward handle 15. A guard 13 acts to protect lever 29 as well as to provide a support for holding the nozzle when it is stored in the fuel pump housing when not in use. The nozzle may also have a vacuum-operated release mechanism for automatically closing flow control valve 20 when the level of fuel in the tank being filled reaches the end of the discharge spout. To this purpose, and as is well known in the art, a vent tube 24 extends through the discharge spout 14 and has an opening or port 50 through the lower surface of the discharge spout near the tip, identified generally by the numeral 80, of the discharge spout. Releasable latching mechanism 22 is automatically operated to close the valve 20 when normal venting of the vacuum mechanism by way of vent tube 24 is interrupted, which occurs when the level of fuel in the tank being filled rises to a level closing the vent passage opening or port 50.

The vapor-recovery system for the nozzle 10 includes a vapor-recovery shroud, indicated generally by numeral 30, which consists of an inner portion 32 and an outer portion 34. The inner portion 32 of the shroud, which is formed with a plurality of circumferentially extending corrugations such that it is readily expanded or contracted as required in use, has an upper end located in a channel 36 formed in the main body portion 12. An annular sealing collar 39 is formed as an integral portion of the outer end of the inner portion 32 of the shroud. A first compression spring 38, which serves to urge inner portion 32 to its extended position, has an inner end bearing against the main body portion 12 and its outer end bearing against an annular spacer ring 40 which is located on the inner face of sealing collar 39. An annular sealing ring 42 is mounted on the discharge spout 14 and extends radially outwardly therefrom. The sealing collar 39 by means of first spring 38 sealingly engages the sealing ring 42 when the inner portion 32 of the shroud is in an extended position. The sealing relationship between the seat 42 and the collar 39 is such that when the inner portion 32 of the shroud is fully extended and a seal is made between the seat 42 and the collar 39 recovered vapors which are located within the nozzle cannot escape into the atmosphere through the open end of the shroud.

The outer portion 34 of the shroud has its inner end mounted in an annular recess 56 formed at the outer end of the inner portion 32, and the inner end of outer portion 34 is secured by appropriate means to the outer end of the inner portion 32. The outer portion 34 of the shroud has a soft annular sealing collar 58 at the outer end thereof with a backing plate 60 located at the inner face of the collar 58. A second extension spring 62 has one end bearing against collar 39 of the inner portion 32 of the shroud and its outer end bearing against the support ring 64. A pair of support arms, not illustrated, project forwardly from support ring 64 on opposite sides of the discharge spout 14 and into shallow recesses in plate 60 so that plate 60 and collar 58 are free to rock about the ends of the support arms to be aligned with the end of the fill pipe 90 when the nozzle is inserted in the fill pipe. When the nozzle is operatively inserted in the fill pipe to a sufficient extent to displace the shroud 30 rearwardly to a contracted position, as shown in FIG. 1, the second spring 62 will yield and will serve to align the collar 58 with the end of the fill pipe. With collar 58 sealingly engaging the fill pipe, vapors displaced from the fuel tank during refueling will be carried back to a vapor-recovery passage, indicated generally by reference numeral 99, which extends from shroud 30 and through the nozzle main body portion 12 where it is connected to vapor recovery line 74. Since the structure of the vapor-receiving system is well known, it has not been described in great detail. A more detailed description of the operation of this vapor-recovery system may be found in U.S. Pat. No. 4,060,110. An alternate vapor-recovery system is described in U.S. Pat. No. 4,058,149.

Figures 1A, 2, 3, 4:
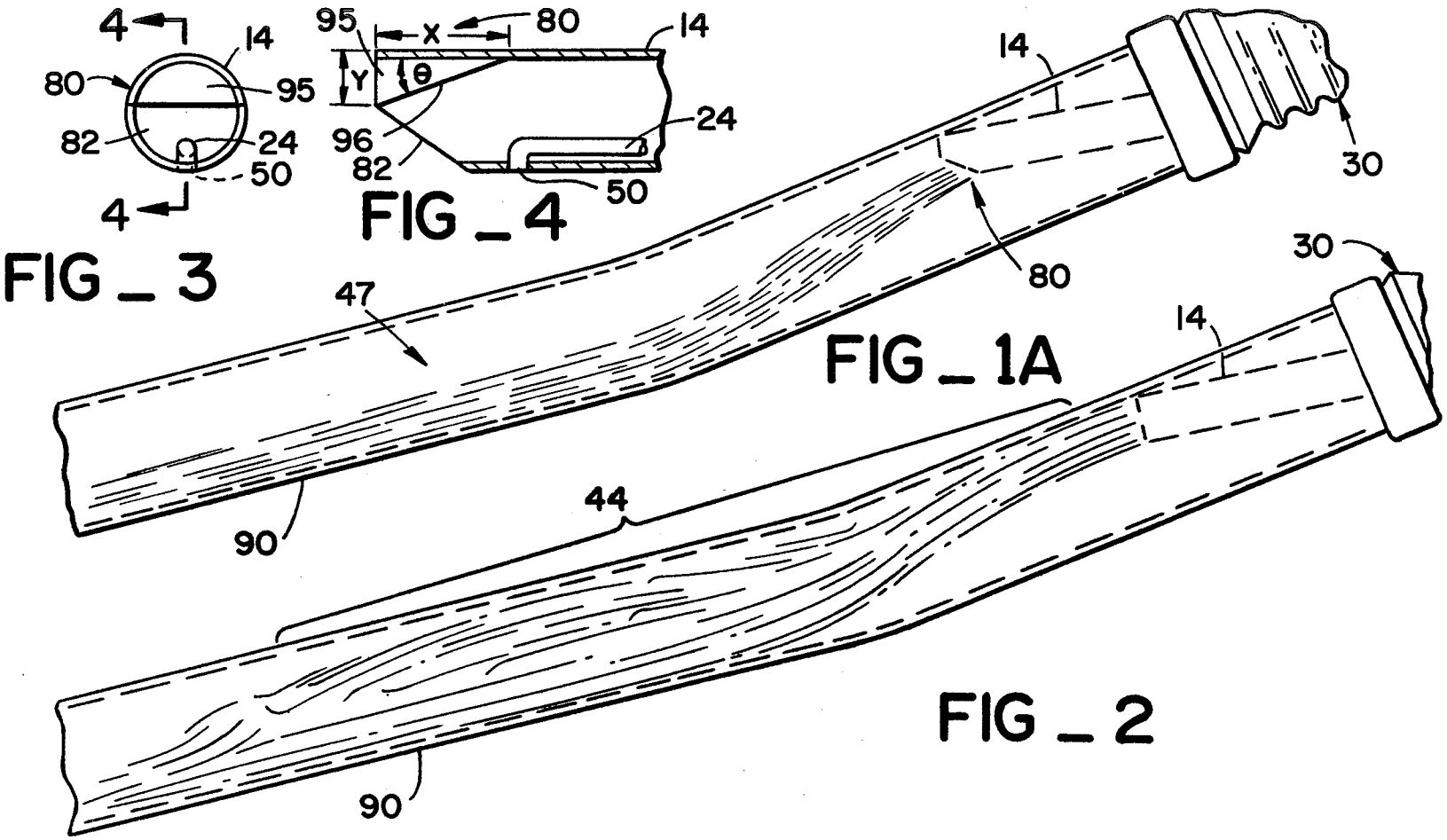
FIG. 1A is an elevational view illustrating the flow of fuel out the discharge spout of the nozzle shown in FIG. 1.
FIG. 2 is an elevational view illustrating the flow of fuel out of the discharge spout of a vapor-recovery dispensing nozzle not using the present invention.
FIG. 3 is an enlarged end view along line 3—3 of FIG. 1.
FIG. 4 is an enlarged fragmentary sectional view taken along line 4—4 of FIG. 3.

In referring to FIG. 2, there is illustrated the problem, as discussed hereinabove, to which the present invention is directed. In FIG. 2, a vapor-recovery nozzle of the type described above is inserted into a fill pipe 90 of a vehicle fuel tank. As illustrated, the nozzle 10 is positioned in the fill pipe such that fuel exiting through the open end of the discharge spout 14 strikes the roof or upper, inner surface of the fill pipe and is directed downwardly along the sides of the fill pipe to the floor or lower surface of the fill pipe, resulting in the formation of a liquid barrier, indicated generally by reference numeral 44, in the fill pipe. The presence of a liquid barrier in the fill pipe causes a buildup of vapor pressure inside the tank head space of many vehicle tanks, which can establish a relatively large pressure differential across the barrier. As vapor passes through this barrier, fuel droplets may be entrained in the vapor and carried into the vapor recovery line, causing the formation of a fuel trap in the line, which can further increase the pressure in the tank head space. As discussed, the formation of a liquid barrier in the fill pipe can cause spitbacks, spills and recirculation.

In accordance with the present invention, in order to eliminate the liquid barrier in the fill pipe, the discharge spout, as illustrated in FIGS. 1, 3 and 4, is provided with a tip 80 having a wedge-shaped projection 95 located on its upper, inner surface adjacent to the outlet end 82 thereof. The wedge-shaped projection 95, as shown in FIG. 1A, deflects fuel flowing through the discharge spout and out the outlet end of the tip in a generally downward direction at an effective angle of deflection, as will be discussed in more detail below, from the center line of the discharge spout so that fuel exiting the discharge spout 14 is directed away from the roof of the fill pipe 90 and allowed to flow along the lower surface of the fill pipe; this leaves an open passage, generally indicated by numeral 47, above the fuel flow through which vapor displaced from the fuel tank may escape. In this manner, the liquid barrier in the fill pipe, as measured by the pressure difference between the pressure in the tank head space and that in the fill pipe near the point of insertion of the discharge spout, is reduced or effectively eliminated.

In arriving at the discharge spout tip design of the present invention, various discharge spout tip configurations were tested on a conventional OPW 7V vapor-recovery nozzle to evaluate their effectiveness in reducing or eliminating liquid barrier formation in the fill pipe of a fuel tank. In conducting these tests, water, which was substituted for gasoline for safety reasons and which essentially has the same flow pattern as gasoline in the fill pipe and which will be referred to as fuel hereinafter, was dispensed at different rates of flow into one of two instrumentated gas tanks—one of which was a standard Ford tank and the other a standard GM tank. The pressure in the tank head space and the pressure in the fill pipe near the point of insertion of the discharge spout were measured by means of pressure transducers to determine the pressure differential, $\Delta P$, in In.-$H_2O$ between these two points and thus across the liquid barrier, if any, formed in the fill pipe. From the test data and visual observation of the flow in the fill pipe, it was found that liquid barrier formation occurred in the fill pipe where the pressure differential between the points of measurement was equal to or greater than 0.1 In.-$H_2O$, the size of the barrier being directly proportional to the magnitude of the pressure differential. It was also determined that for a pressure differential of less than approximately 0.025 In.-$H_2O$ there was essentially no liquid barrier formed in the fill pipe.

The four discharge spout tip configurations tested on the OPW 7V vapor-recovery nozzle, which was self-latched as opposed to being hand-held in the tank fill pipe, are illustrated in FIGS. 6A–6D. The pressure differentials measured in the Ford and GM fill pipes for each spout tip and for an unmodified OPW 7V nozzle, which was self-latched into the fill pipe and which was used as a reference point, are shown in Table I.

Figure 6A:
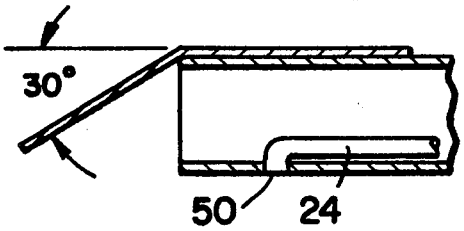
FIGS. 6A through 6D, inclusive, are sectional views of different discharge spout tip configurations for liquid fuel dispensing nozzles.
Figure 6B:
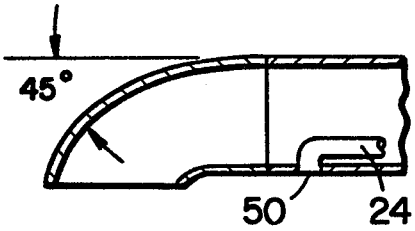

As shown in FIG. 6A, spout Tip A consisted of a flat metal deflector attached to the OPW 7 V nozzle discharge spout so as to slope downwardly from the upper surface of the discharge spout at an angle of 30°. Fuel flowing through the discharge spout and out the open end thereof was deflected by Tip A at an angle of deflection from the center line of the discharge spout that equals 30°. For Tip A, taking the unmodified OPW 7V nozzle as a reference point, it can be seen from Table I that the pressure differential measured in the Ford fill pipe was greater than that of the unmodified nozzle. On the other hand, Tip A as compared with the unmodified nozzle reduced the pressure differential in the GM fill pipe. It was also observed during the test that fuel exiting the discharge spout sprayed out around the sides of Tip A causing a build-up of fuel behind the open end of the discharge spout which blocked port 50. With port 50 blocked, the automatic release mechanism was prematurely activated to shut off the nozzle. In an attempt to eliminate this problem, the Tip B design was proposed, see FIG. 6B.

Tip B was fabricated by attaching a 45° fitting to the open end of the discharge spout. Tip B was effective in reducing the pressure differential in the Ford tank. However, in the GM tank, as with Tip A, fuel could not be dispensed because of the fuel buildup behind the open end of the spout, which, as noted above, prematurely activated the automatic release mechanism.

Figure 6C:
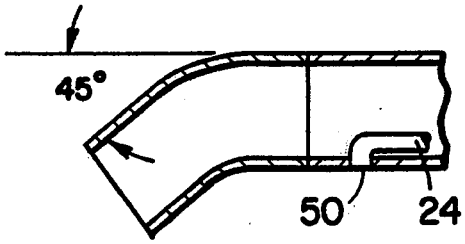

The next discharge spout design that was tested, Tip C shown in FIG. 6C, was a variation of Tip B. Tip C had an oval opening, as opposed to the semi-elliptical opening of Tip B, designed to spread the fuel flow out over a wider area of the lower surface of the fill pipe in an attempt to prevent fuel buildup behind the open end of the spout. However, the angle of deflection of the fuel from the center line of the spout, 45°, was too great in that fuel buildup behind the open end of the discharge spout was still occurring.

Figure 6D:
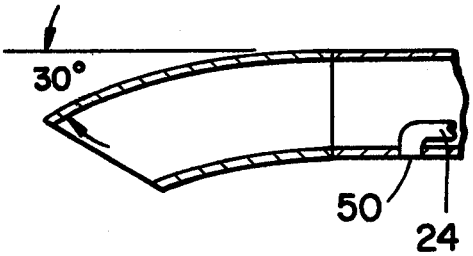

Tip D, FIG. 6D, consisted of a curved extension angling downwardly from the upper surface of the discharge spout at an angle of approximately 30°. Tip D had a slightly pinched opening designed to spread the fuel flow out over the lower surface of the fill pipe. Tip D was found to be effective in reducing the pressure differential in the fill pipe and in eliminating the fuel buildup behind the open end of the nozzle spout, thereby preventing premature activation of the automatic release mechanism. However, in subsequent field testing, Tip D was found to be undesirable in that it lacked insertion compatibility with many fill pipe geometries.

TABLE I

ΔP BETWEEN TANK HEAD SPACE AND FILL PIPE NEAR POINT OF INSERTION OF DISCHARGE SPOUT FOR DIFFERENT TIP CONFIGURATIONS

| | ΔP Unmodified OPW 7V Nozzle | ΔP | | | |
|---|---|---|---|---|---|
| | | Tip A | Tip B | Tip C | Tip D |
| Ford Tank Flow | | | | | |
| 5 gpm | <0.01 | 0.19 | <0.01 | <0.01 | <0.01 |
| 9 gpm | 0.025 | 0.28 | 0.025 | <0.01 | 0.05 |
| 17 gpm | 0.48 | 0.58 | 0.23 | * | 0.35 |
| GM Tank Flow | | | | | |
| 5 gpm | 0.2 | 0.05 | * | <0.01 | <0.01 |
| 9 gpm | 0.7 | 0.40 | * | * | 0.04 |
| 17 gpm | * | * | * | * | 1.75 |

*Wouldn't Dispense.

The experimental procedures described above were also used in testing the wedge-shaped projection of the present invention. Four different-sized projections were tested having lengths X, see FIGS. 3 and 4, of 0.5 and 1.0 inch and having a fuel-deflecting surface 96 sloping downwardly from the upper surface of the tip of the discharge spout at angles $\theta$ of 20° and 25°. The particular values that were chosen for $\theta$ were based on the results obtained in the testing of Tips A–D wherein it was determined that a deflection angle much in excess of 30° would present problems with fuel buildup at port 50 of the automatic release mechanism. On the other hand, if $\theta$ had a value much less than 20°, the fuel exiting through the outlet end of the tip would not be deflected at a sufficient angle from the center line of the discharge spout to be directed away from the roof of the fill pipe. In this respect, the lower limit for $\theta$ can be considered as approximately 10°.

The length X of the projection 95 is a function of the value selected for $\theta$ and the cross-sectional area required for the outlet end 82 of the tip 80 of the discharge spout. To explain more fully, locating the wedge-shaped projection 95 on the upper, inner surface of the tip of the discharge spout considerably reduces the cross-sectional area of the discharge spout at the outlet end of the tip. A decrease in the cross-sectional area of the outlet end causes an increase in the velocity of the fuel flowing out the discharge spout and into the fill pipe. This flow may be initially deflected away from the roof of the fill pipe as the fuel strikes the sloping surface 96 of projection 95; however, the increased velocity of the flow will cause the fuel to travel up and along the sides of the fill pipe to the roof of the fill pipe from where the fuel will fall, causing the formation of a liquid barrier in the fill pipe. In support of this, see Tables II and III wherein the data indicate that fitting the projection to either an OPW 7VN or Emco Wheaton A303 nozzle without modifying the outlet end by increasing its cross-sectional area was not an effective means for eliminating barrier formation in the fill pipe at the higher flow rates. In order to decrease the flow velocity through the tip's outlet end, the cross-sectional area of the outlet end 82 must be increased. As illustrated in FIG. 4, this is accomplished by angling the outlet end inwardly from the upper surface of the tip so as to provide a flow passage of generally uniform cross-sectional area throughout the length of the discharge spout, that is, the cross-sectional area of the outlet end 82 is approximately equal to the cross-sectional area of the flow passage extending through the discharge spout inwardly of tip 80. The point to which the outlet end 82 can be extended inwardly, however, is limited by the location of port 50; in other words, the outlet end can only be angled inwardly to a point outwardly of port 50. Therefore, the extent to which the cross-sectional area of outlet end 82 can be increased so as to approximately equal that of the flow passage through the discharge spout inwardly of projection 95 is limited. In turn, this means that the depth Y of projection 95 must be chosen such that the outlet end which angles inwardly from the upper surface of the tip has a cross-sectional area approximately equal to that of the flow passage in the discharge spout inwardly of the tip. Thus, with the value $\theta$ determined as above and with the value for Y being limited by the cross-sectional area that has to be provided at outlet end 82, it is seen that length X is a trigonometric formation of Y and $\theta$.

TABLE II

| | | | ΔP, In.-$H_2O$ FOR GM TANK | | | | |
|---|---|---|---|---|---|---|---|
| | | | Wedge-Shaped Projection | | | | |
| Vapor-Recovery Nozzle | Flow, gpm | No Modifications | 1.0 In. 20° | 0.5 In. 20° | 1.0 In. 25° | 0.5 In. 25° | Tip D |
| OPW 7VN (Leaded) | 4.6 | 0.25 | * | <0.025 | * | <0.025 | <0.025 |
| With No Spout | 4.6 | 0.15 | — | — | — | — | — |
| Tip Cut-Away | 4.6 | 0.18 | — | — | — | — | — |
| Modifications | 4.6 | — | — | — | — | — | <0.025 |
| | 8.0 | 0.80 | * | 0.56 | * | 0.25 | 0.13 |
| | 8.0 | 0.53 | — | — | — | — | — |
| | 8.0 | 0.60 | — | — | — | — | — |
| | 8.0 | — | — | — | — | — | 0.05 |
| OPW 7VN (Leaded) | 4.3 | 0.25 | — | — | — | — | — |
| With Tip Cut- | 4.4 | 0.30 | — | — | — | — | — |
| Away Spout | 4.6 | 0.28 | <0.025 | <0.025 | <0.025 | <0.025 | <0.025 |
| | 5.0 | 0.33 | — | — | — | — | — |
| | 5.2 | 0.38 | — | — | — | — | — |
| | 5.2 | 0.20 | — | — | — | — | — |
| | 5.2 | 0.30 | — | — | — | — | — |
| | 5.2 | 0.40 | — | — | — | — | — |
| | 5.2 | — | — | — | — | — | <0.025 |
| | 5.2 | — | — | — | — | — | — |

TABLE II-continued

| Vapor-Recovery Nozzle | Flow, gpm | No Modifications | ΔP, In.-$H_2O$ FOR GM TANK Wedge-Shaped Projection 1.0 In. 20° | 0.5 In. 20° | 1.0 In. 25° | 0.5 In. 25° | Tip D |
|---|---|---|---|---|---|---|---|
| | 6.0 | 0.58 | — | — | — | — | — |
| | 6.3 | 0.58 | — | — | — | — | — |
| | 7.1 | 0.63 | — | — | — | — | — |
| | 7.5 | 0.73 | — | — | — | — | — |
| | 7.5 | 0.88 | — | — | — | — | — |
| | 8.0 | 0.75 | — | — | — | — | — |
| | 8.0 | 0.93 | — | — | — | — | — |
| | 8.0 | 1.0 | 0.25 | 0.06 | 0.18 | 0.08 | 0.15 |
| | 8.6 | >2.00* | — | — | — | — | — |
| | 8.6 | — | — | — | — | — | <2.00* |
| | 8.6 | — | — | — | — | >2.00 | — |
| | 8.6 | >2.00* | — | — | — | — | — |

*Would not dispense consistently.

TABLE III

| Vapor-Recovery Nozzle | Flow, gpm | No Modifications | ΔP, In.-$H_2O$ FOR GM TANK Wedge-Shaped Projections 1.0 In. 20° | 0.5 In. 20° | 1.0 In. 25° | 0.5 In. 25° | Tip D |
|---|---|---|---|---|---|---|---|
| Emco Wheaton A303 | 4.0 | 0.19 | 0.83 | 0.025 | * | <0.025 | <0.025 |
| (Leaded) With | 4.0 | 0.21 | — | — | — | — | — |
| No Spout Tip | 4.0 | — | — | — | — | — | <0.025 |
| Cut-Away | 4.0 | — | — | — | — | <0.025 | — |
| Modifications | 4.0 | 0.18 | — | — | — | — | — |
| | 5.0 | 0.18 | — | — | — | — | — |
| | 7.5 | 0.40 | — | — | — | — | — |
| | 8.0 | 0.38 | — | — | — | — | — |
| | 8.0 | 0.45 | — | — | — | — | — |
| | 8.0 | — | — | — | — | — | 0.13 |
| | 8.0 | — | — | — | — | 0.30 | — |
| | 8.0 | 0.40 | — | — | — | 0.25 | — |
| | 8.0 | 0.38 | — | — | — | — | — |
| | 10.0 | 0.73 | — | — | — | — | — |
| | 10.0 | 0.50 | — | — | — | — | — |
| | 10.0 | — | — | — | — | — | 0.10 |
| Emco Wheaton A303 | 4.0 | 0.15 | — | — | — | — | — |
| (Leaded) With | 4.0 | — | <0.025 | — | — | — | — |
| Spout Tip Cut Away | 4.0 | — | — | <0.025 | — | — | — |
| | 4.0 | — | — | — | <0.025 | — | — |
| | 4.0 | — | — | — | — | <0.025 | — |
| | 4.0 | — | — | — | — | — | <0.025 |
| | 8.0 | 0.38 | — | — | — | — | — |
| | 8.0 | — | 0.25 | — | — | — | — |
| | 8.0 | — | — | 0.10 | — | — | — |
| | 8.0 | — | — | — | 0.43 | — | — |
| | 8.0 | — | — | 0.05 | — | — | 0.15 |

*Would not dispense consistently.

If existing nozzles are to be retrofitted with projection 95, as was done in this test, the underside of the nozzle discharge spout at the open end thereof would be preferably cut away so that the tip outlet end angles inwardly to provide a generally uniform cross-sectional area for the flow passage extending through the discharge spout. In this case, the projection is secured by any appropriate means, such as a screw, not illustrated, to the upper surface of the tip. The nozzles could, of course, be manufactured such that the projection is an integral part of the discharge spout tip and such that the tip outlet end angles inwardly to provide the requisite cross-sectional area for the flow of fuel through the discharge spout.

In either of the above cases, as shown in FIGS. 3 and 4, projection 95 is located on the upper, inner surface of tip 80 so that its larger end is facing toward the outlet end 82 of the tip. The projection will then be positioned such that it tapers from wide to narrow in the direction away from the outlet end of the tip. Although the larger end of the projection may be rectangular, square or of some other geometry, it is preferable that it have an arcuate shape so that the outer edge curved portion of the larger end contiguously engages the inner surface of the tip at the outlet end thereof.

Referring to Tables II and III, it can be seen that the discharge spout tip configuration of the present invention effectively eliminated liquid barrier formation in the fill pipe at the low flow rates and significantly reduced the pressure differential, using the unmodified OPW 7VN and the Emco Wheaton A303 nozzles as points of reference, in the fill pipe at the higher flow rates. From these tests, it was determined that at the higher flow rates the projections having a length X of ½ inch were more effective than the projections having a length of 1.0 inch in reducing the pressure differential in the fill pipe. With the longer projections, the cross-sectional area of the flow passage in the tip area of the discharge spout is somewhat smaller than it would be with the shorter projections; this has the effect of increasing the fuel exit velocity which causes a more turbulent flow in the fill pipe which in turn tends to increase the pressure differential in the fill pipe. Visual observations of the fuel flow in the Ford fill pipe indicated that the 25°½ inch projection was slightly better than the 20°-½ inch projection in that the 25° projection provided a somewhat larger passage 47, see FIG. 1A, above the fuel flow through which vapor displaced from the fuel tank could escape.

The 25°-½ inch projection—retrofitted on leaded and unleaded OPW 7VN and Emco Wheaton A303 nozzles with the underside of the discharge spout at its open end being cut away to provide a cross-sectional area for the tip outlet end approximately equal to that of the discharge spout inwardly of the tip—was also field-tested to evaluate the projection's effectiveness in reducing spitbacks and spills under actual service conditions. In the field test, 170 vehicles were refueled at a test service station using the four above-described modified nozzles; the results of this test are shown in Table IV.

TABLE IV

| | Modified OPW 7VN Nozzle | | Modified Emco Wheaton A303 Nozzle | |
|---|---|---|---|---|
| | Leaded | Unleaded | Leaded | Unleaded |
| No Spitback or Spill Occurrence | 41 | 53 | 32 | 30 |
| Spitback or Spill Occurrence | 6 | 4 | 1 | 3 |
| Total Fills | 47 | 57 | 33 | 33 |

The data from Table IV may be compared with the data shown in Table V. The data in Table V were obtained by the San Francisco Bay Area Pollution Control District during field tests conducted with the four above-discussed nozzle types unmodified by the addition of the present invention.

TABLE V

| | Conventional OPW 7VB Nozzle | | Conventional Emco Wheaton A303 Nozzle | |
|---|---|---|---|---|
| | Leaded | Unleaded | Leaded | Unleaded |
| No Spitback or Spill Occurrence | 326 | 135 | 129 | 51 |
| Spitback or Spill Occurrence | 64 | 30 | 14 | 14 |
| Total Fills | 390 | 165 | 14 | 65 |

As can be seen from Tables IV and V, the relative frequency of spitbacks and spills was considerably reduced when the nozzles were retrofitted with the wedge-shaped projection of the present invention. With the modified OPW leaded nozzle, the frequency of occurrence of spitback or spills was 22% less than that of the unmodified nozzle, and with the other three modified nozzle types, the frequency of occurrence of spitback or spills was half or less than that of the unmodified nozzles.

Figure 5:
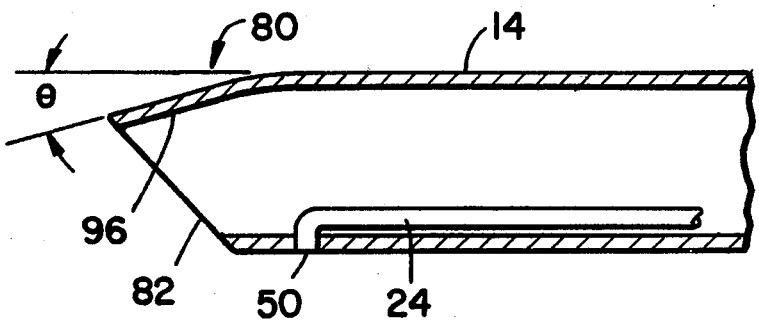
FIG. 5 is a sectional view of a discharge spout tip configuration of a liquid fuel-dispensing nozzle illustrating an alternate embodiment of the present invention.

The wedge-shaped projections described above are preferably used in retrofitting existing nozzles. In the fabrication of new nozzles, the results obtained with the wedge-shaped projection may be arrived at by constructing the discharge spout tip as shown in FIG. 5. The upper surface of the discharge spout tip forms a fuel-deflecting surface 96 that slopes downwardly from a point on the upper surface of the discharge spout at angle $\theta$ so that the fuel exiting through the outlet end 82 of the discharge spout tip 80 is deflected from the center line of the discharge spout and away from the upper surface of the fill pipe.

The angle $\theta$ at which the upper surface of the tip slopes may be any of the values previously discussed with respect to the wedge-shaped projection and is preferably either 20° or 25°. As with projection 95, the outlet end 82 should angle inwardly from the upper surface of the tip so that the flow passage extending from the outlet end of the tip and through the discharge spout is of generally uniform cross-sectional area.

SUMMARY OF THE ADVANTAGES

The discharge spout tip design of the present invention offers a relatively simple and economic means for eliminating and/or reducing liquid barrier formation in the fill pipe of a vehicle fuel tank and thereby reducing the occurrence of spitback and spills. The embodiments of the present invention are simple and economic to manufacture, and the wedge-shaped projections offer the additional advantage of being easily retrofitted to nozzles currently in use.

Although certain specific embodiments of the invention have been described in detail, the invention is not to be limited to only such embodiments but rather only by the appended claims.

What is claimed is:

1. A liquid fuel-dispensing nozzle, comprising a nozzle main body portion, a discharge spout projecting from the main body portion for insertion into a fill pipe of a fuel tank, a flow passage extending through the main body portion and said discharge spout for the flow of fuel therethrough, and a tip of said discharge spout proportioned for ease of insertion into the fill pipe, said tip having an outlet end of cross-sectional area approximately equal to that of said flow passage extending through said discharge spout inwardly of said tip, and said tip having a downwardly sloping upper surface for deflecting fuel flowing through said flow passage and out of said outlet end in a generally downward direction at an effective angle of deflection from the center line of said discharge spout so that fuel flowing through said outlet end is directed away from the upper surface of the fill pipe in order to prevent the formation of a liquid barrier therein.

2. The liquid fuel-dispensing nozzle or claim 1 wherein the downwardly sloping surface of said tip slopes at an angle of between about 10° and 30°.

3. The liquid fuel-dispensing nozzle of claim 1 wherein the downwardly sloping surface of said tip slopes at an angle of between about 20° and 25°.

4. The liquid fuel-dispensing nozzle of claim 1 wherein the downwardly sloping surface of said tip slopes at an angle of about 20°.

5. The liquid fuel-dispensing nozzle of claim 1 wherein the downwardly sloping surface of said tip slopes at an angle of about 25°.

6. The liquid fuel-dispensing nozzle of claim 1 wherein said tip has a wedge-shaped projection located on the upper surface thereof to form a fuel-deflecting surface that slopes downwardly from the upper surface of said tip to said outlet end, said wedge-shaped projection having an arcuate-shaped larger end facing toward said outlet end so that said wedge-shaped projection tapers from wide to narrow in the direction away from said outlet end, the outer curved portion of said larger end contiguously engaging the inner surface of said tip at said outlet end and said outlet end angling inwardly of the upper surface of said tip so that the cross-sectional area of said outlet end approximately equals that of said flow passage extending through said discharge spout inwardly of said wedge-shaped projection.

7. The liquid fuel-dispensing nozzle of claim 6 wherein the fuel-deflecting surface of said wedge-shaped projection slopes at an angle of between about 10° and 30°.

8. The liquid fuel-dispensing nozzle of claim 6 wherein the fuel-deflecting surface of said wedge-shaped projection slopes at an angle of between about 20° and 25°.

9. The liquid fuel-dispensing nozzle of claim 6 wherein said wedge-shaped projection has a length of between approximately ½ and 1 inch.

10. The liquid fuel-dispensing nozzle of claim 6 wherein said wedge-shaped projection has a length of between approximately ½ and 1 inch and the fuel-deflecting surface of said wedge-shaped projection slopes at an angle of between about 20° and 25°.

11. The liquid fuel-dispensing nozzle of claim 6 wherein said wedge-shaped projection has a length of approximately ½ inch and the fuel-deflecting surface of said wedge-shaped projection slopes at an angle of about 20°.

12. The liquid fuel-dispensing nozzle of claim 6 wherein said wedge-shaped projection has a length of approximately 1 inch and the fuel-deflecting surface of said wedge-shaped projection slopes at an angle of about 20°.

13. The liquid fuel-dispensing nozzle of claim 6 wherein said wedge-shaped projection has a length of approximately ½ inch and the fuel-deflecting surface of said wedge-shaped projection slopes at an angle of about 25°.

14. The liquid fuel-dispensing nozzle of claim 6 wherein said wedge-shaped projection has a length of approximately 1 inch and the fuel-deflecting surface of said wedge-shaped projection slopes at an angle of about 25°.

15. The liquid fuel-dispensing nozzle of claim 1 wherein said tip has an upper surface that slopes downwardly from a point on said discharge spout remote from the nozzle main body portion to said outlet end to form a fuel-deflecting surface, said outlet end angling inwardly of the upper surface of said tip to provide a cross-sectional area for said outlet end that approximately equals that of said flow passage extending through said discharge spout inwardly of said tip.

16. The liquid fuel-dispensing nozzle of claim 15 wherein the upper surface of said tip slopes downwardly at an angle of between about 10° and 30°.

17. The liquid fuel-dispensing nozzle of claim 15 wherein the upper surface of said tip slopes downwardly at an angle of between about 20° to 25°.

18. The liquid fuel-dispensing nozzle of claim 15 wherein the upper surface of said tip slopes downwardly at an angle of about 20°.

19. The liquid fuel-dispensing nozzle of claim 15 wherein the upper surface of said tip slopes downwardly at an angle of about 25°.

20. In a vapor-recovery dispensing nozzle having a main body portion, a discharge spout projecting from the main body portion for insertion into a fill pipe of a fuel tank, a fuel flow passage extending through the main body portion and said discharge spout, a tip of said discharge spout having an outlet end proportioned for ease of insertion into the fill pipe, vapor-recovery passage means formed in the main body portion, a vent tube extending through said fuel flow passage to form a primary vent passage having an opening in said discharge spout near the outlet end of said tip, and a release mechanism for automatically preventing the flow of fuel into the fuel tank when the level of fuel in the fuel tank being filled thereby rises above a level sufficient to block the primary vent passage opening, the improvement comprising:

a wedge-shaped projection locatable on the upper surface of said tip inwardly of and adjacent to the outlet end thereof so that one surface of said wedge-shaped projection slopes downwardly from the upper surface of said tip towards the outlet end thereof to form a fuel-deflecting surface for deflecting the flow of fuel through the outlet end of said tip away from the upper surface of the fill pipe, said wedge-shaped projection having an arcuate-shaped larger end for facing towards the outlet end of said tip so that said wedge-shaped projection tapers from wide to narrow in the direction away from the outlet end of said tip, the outer curved portion of said larger end contiguously engaging the inner surface of said tip at the outlet end thereof, and the outlet end of said tip angling inwardly from said wedge-shaped projection to a point outwardly of the vent passage opening in order to provide a generally uniform cross-sectional area for said flow passage extending through said discharge spout.

21. The vapor-recovery dispensing nozzle of claim 20 further including means for securing said wedge-shaped projection to the upper surface of said tip.

22. The vapor-recovery dispensing nozzle of claim 20 wherein the length of said wedge-shaped projection is between approximately ½ and 1 inch and said fuel-deflecting surface slopes at an angle of between about 10° and 30°.

23. The vapor-recovery dispensing nozzle of claim 20 wherein the length of said wedge-shaped projection is approximately ½ inch and said fuel-deflecting surface slopes at an angle of about 20°.

24. The vapor-recovery dispensing nozzle of claim 20 wherein the length of said wedge-shaped projection is approximately 1 inch and said fuel-deflecting surface slopes at an angle of about 20°.

25. The vapor-recovery dispensing nozzle of claim 20 wherein the length of said wedge-shaped projection is approximately ½ inch and said fuel-deflecting surface slopes at an angle of about 25°.

26. The vapor-recovery dispensing nozzle of claim 20 wherein the length of said wedge-shaped projection is approximately 1 inch and said fuel-deflecting surface slopes at an angle of about 25°.

27. A method for preventing the formation of a liquid barrier in a fill pipe of a fuel tank when the fuel tank is being filled by a liquid fuel-dispensing nozzle, the fuel-dispensing nozzle including a main body portion, a discharge spout projecting from the main body portion for insertion into the fill pipe, and a flow passage extending through the main body portion and said discharge spout for the flow of fuel therethrough, comprising:

forming a tip for said discharge spout with an outlet end proportioned for ease of insertion into the fill pipe and with an upper surface that slopes downwardly for deflecting fuel flowing through said flow passage and out the outlet end of said tip in a generally downward direction at an effective angle of deflection from the center line of said discharge spout so that fuel flowing through the outlet end of said discharge spout is directed away from the upper surface of the fill pipe; and angling the outlet end of said tip inwardly of the upper surface of said tip so that the cross-sectional area of said outlet end approximately equals that of said flow passage extending through said discharge spout inwardly of said tip.

28. The method of claim 27 wherein the upper surface of said tip slopes downwardly at an angle of between about 10° and 30°.

29. The method of claim 27 wherein the upper surface of said tip slopes downwardly at an angle of between about 20° and 25°.

30. A method of modifying a liquid fuel-dispensing nozzle for preventing the formation of a liquid barrier in a fill pipe of a fuel tank when the fuel tank is being filled by use of the liquid fuel-dispensing nozzle, the fuel-dispensing nozzle including a main body portion, a discharge spout projecting from the main body portion for insertion into the fill pipe, a flow passage extending through the main body portion and said discharge spout for the flow of fuel therethrough, and a tip of said discharge spout having an outlet end proportioned for ease of insertion into the fill pipe, comprising:

locating a wedge-shaped projection on the upper surface of said tip inwardly of and adjacent to the outlet end thereof wherein one surface of said wedge-shaped projection slopes downwardly from the upper surface of said tip towards the outlet end thereof to form a fuel-deflecting surface for deflecting the flow of fuel through the outlet end of said tip away from the upper surface of the fill pipe, said wedge-shaped projection having an arcuate-shaped larger end facing towards the outlet end of said tip so that said wedge-shaped projection tapers from wide to narrow in the direction away from the outlet end of said tip, the outer curved portion of said larger end contiguously engaging the inner surface of said tip at the outlet end thereof; and cutting away the bottom surface of said tip so that the outlet end of said tip angles inwardly from said wedge-shaped projection in order to provide a generally uniform cross-sectional area for said flow passage extending through said discharge spout.

31. The method of claim 30 wherein the length of said wedge-shaped projection is between approximately ½ and 1 inch and said fuel-deflecting surface slopes at an angle of between about 10° and 30°.

32. The vapor-recovery dispensing nozzle of claim 30 wherein the length of said wedge-shaped projection is approximately ½ inch and said fuel-deflecting surface slopes at an angle of about 20°.

33. The vapor-recovery dispensing nozzle of claim 30 wherein the length of said wedge-shaped projection is approximately 1 inch and said fuel-deflecting surface slopes at an angle of about 20°.

34. The vapor-recovery dispensing nozzle of claim 30 wherein the length of said wedge-shaped projection is approximately ½ inch and said fuel-deflecting surface slopes at an angle of about 25°.

35. The vapor-recovery dispensing nozzle of claim 30 wherein the length of said wedge-shaped projection is approximately 1 inch and said fuel-deflecting surface slopes at an angle of about 25°.

* * * * *